US009730537B1

(12) United States Patent
Gilmore et al.

(10) Patent No.: US 9,730,537 B1
(45) Date of Patent: Aug. 15, 2017

(54) TRAVEL CLOUD PILLOW

(71) Applicant: The Northwest Company, LLC, Roslyn, NY (US)

(72) Inventors: Elizabeth Anne Gilmore, Lindenhurst, NY (US); Jillian Ilyssa Ivler, Plainview, NY (US)

(73) Assignee: The Northwest Company, LLC, Roslyn, NY (US)

( * ) Notice: Subject to any disclaimer, the term of this patent is extended or adjusted under 35 U.S.C. 154(b) by 0 days.

(21) Appl. No.: 15/361,585

(22) Filed: Nov. 28, 2016

Related U.S. Application Data

(60) Provisional application No. 62/348,206, filed on Jun. 10, 2016, provisional application No. 62/357,454, filed on Jul. 1, 2016.

(51) Int. Cl.
*A47G 9/10* (2006.01)
*B68G 7/06* (2006.01)
*D04B 1/22* (2006.01)

(52) U.S. Cl.
CPC ..... *A47G 9/10* (2013.01); *B68G 7/06* (2013.01); *D04B 1/22* (2013.01)

(58) Field of Classification Search
CPC ..... A47G 9/10
USPC ..... 5/636, 630; 428/76, 68
See application file for complete search history.

(56) References Cited

U.S. PATENT DOCUMENTS 4,116,148 A * 9/1978 Torrez ..... A47C 3/16 112/475.16
5,659,911 A * 8/1997 Kirkbride ..... A47G 9/10 428/401

* cited by examiner

*Primary Examiner* — Fredrick Conley
(74) *Attorney, Agent, or Firm* — Collard & Roe, P.C.

(57) ABSTRACT

A pillow has a knit cover with a crimped siliconized polyester fill. The pillow is sewn into a spheroid shape, which can be adorned with any desired decoration, such as forming the pillow to resemble the head of a character. The outer cover is made of a polyester derived knit matrix in which the weft of the knit matrix has been scratched and raised to produce a nap averaging 2 mm in height. The outer cover is sliver knit on a warp machine to create a unique texture and feel. After knitting, the fibrous yarn is sheared to create a velvet-like pile. The fill encased within the spheroid is 100% siliconized polyester fiber that is created by melt spinning. The fiber has been crimped at an average 9 crimps per inch. The pillow contains no more than 70 grams of fiber per one inch of diameter. This ratio provides the optimal deformation and pressure for a heightened sensory experience.

3 Claims, 5 Drawing Sheets

TRAVEL CLOUD PILLOW

CROSS-REFERENCE TO RELATED APPLICATIONS

This application claims priority under 35 USC 119(e of U.S. Provisional Application Nos. 62/348,206 filed on Jun. 10, 2016 and 62/357,454, filed on Jul. 1, 2016, the disclosures of which are herein incorporated by reference.

BACKGROUND OF THE INVENTION

1. Field of the Invention

This invention relates to a pillow having a unique feel due to its cover fabric and fill. In particular, the invention relates to a pillow useful for travel or other uses that has a uniquely soft and resilient texture.

2. The Prior Art

Travel and throw pillows can be made of various different cover fabrics and fills. For a pillow useful for travel, it is desirable that the pillow have both a soft feel and a resilient texture so that it never becomes flattened. Various attempts have been made to create a durable, soft cover as well as a resilient fill that still is soft and yielding. Fills that have been used in the past include foam, styrofoam beads, down feathers, and polyester fibers.

SUMMARY OF THE INVENTION

The present invention relates to a unique combination of a knitted cover with a crimped siliconized polyester fill. The pillow is sewn into a spheroid shape, which can be adorned with any desired decoration, such as forming the pillow to resemble the head of a character.

The pillow is a deformable knit spheroid that encases a fill made of hollow, siliconized, conjugate, virgin polyester fiber. The outer cover is made of a polyester derived knit matrix, weighing a minimum of 180 grams per square meter, and preferably 280 grams per square meter. The weft of the knit matrix has been scratched and raised to produce a nap averaging 2 mm in height. The base yarn is preferably PBT and the fibrous yarn used in the pile is 100% polyester. The outer cover is sliver knit on a warp knitting machine to create a unique texture and feel. After knitting, the fibrous yarn is sheared to create a velvet-like pile.

The fill encased within the spheroid is 100% siliconized polyester fiber with each filament averaging between 7 and 10 microns in diameter. The fill is created by melt spinning. The fiber has been crimped at an average 9 crimps per inch. The pillow contains no more than 70 grams of fiber per one inch of diameter. This ratio provides the optimal deformation and pressure for a heightened sensory experience.

The combination of the specially knit outer cover with the crimped fiber fill gives the pillow truly unique properties. The fill is resilient yet soft, and the outer fabric cover is also especially resilient and yielding, giving the pillow a pleasant "squishy" feeling.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
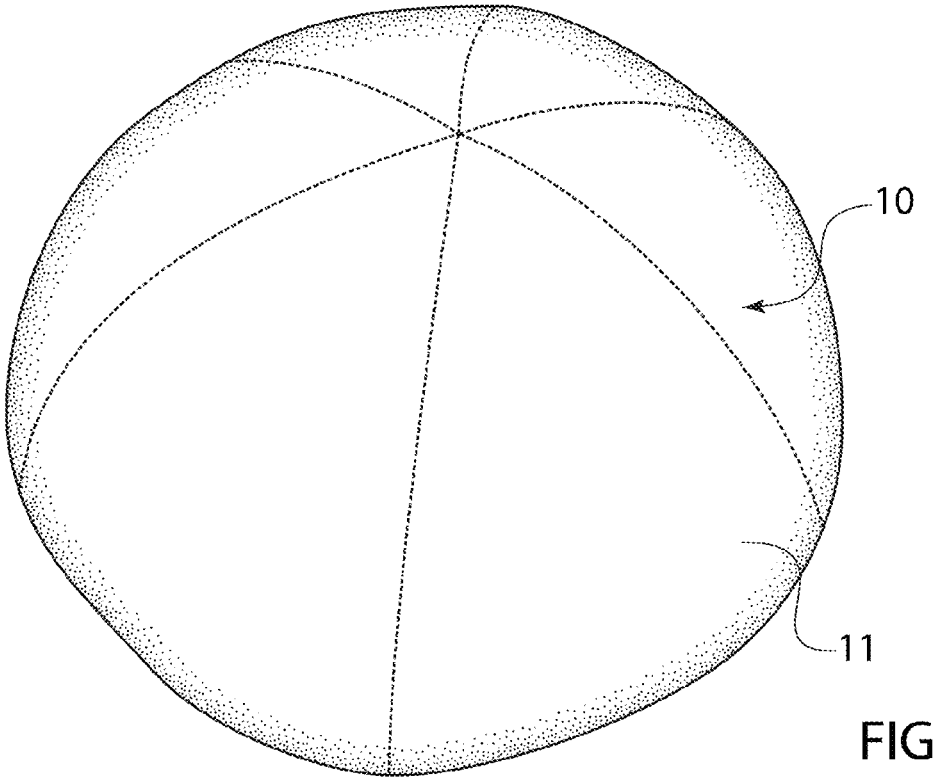
FIG. 1 shows a view of a pillow according to the invention.
Figure 2:
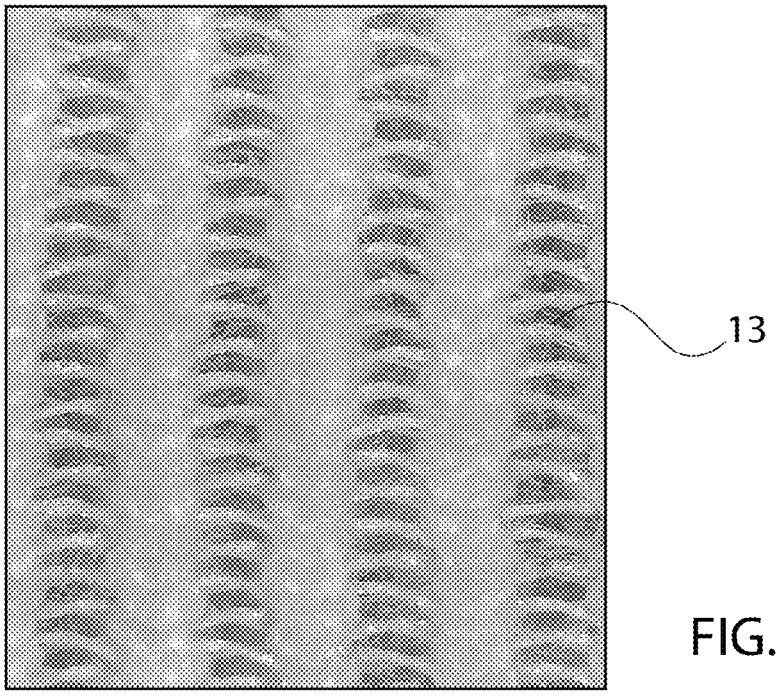
FIG. 2 shows an enlarged photograph of the fabric for the cover layer according to the invention.
Figure 3:
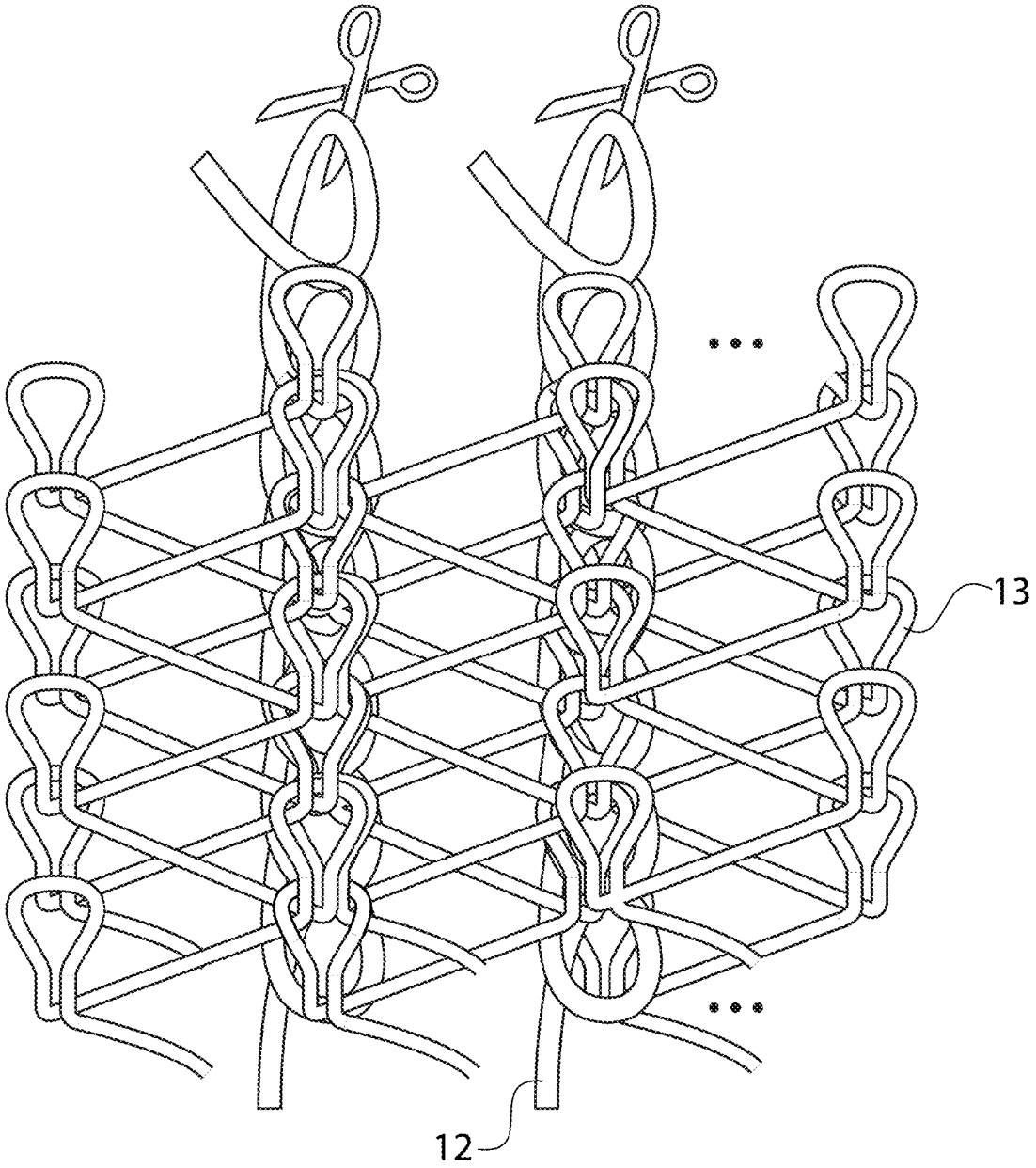
FIG. 3 shows a view of the underside of the fabric.
Figure 5:
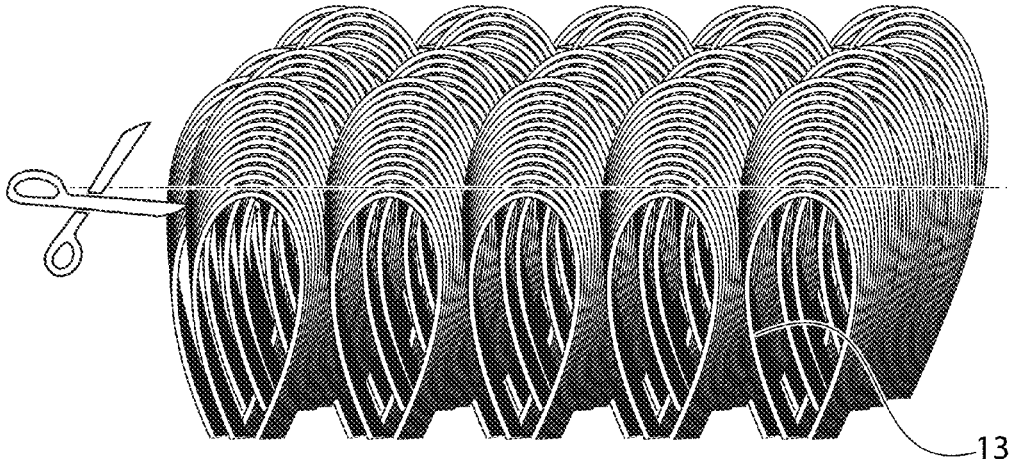
FIG. 5 shows the pile material prior to shearing.

Referring now in detail to the drawings and, FIG. 1 shows the pillow 10 according to the invention. The pillow is a spheroid shape made by sewing several panels of the cover layer 11 together. The knit cover layer is shown in FIGS. 2 and 3. The cover layer 11 is formed from a base yarn 12 with a stretch, such as PBT (polybutylene tetraphthalate). Knitted into this base layer in a sliver knitting process is a fibrous fluffy polyester yarn 13 in such a manner that a looped pile results after coming or scratching the knit. This looped pile is then sheared as shown in FIG. 5 to create cut pile nap.

Figure 4:
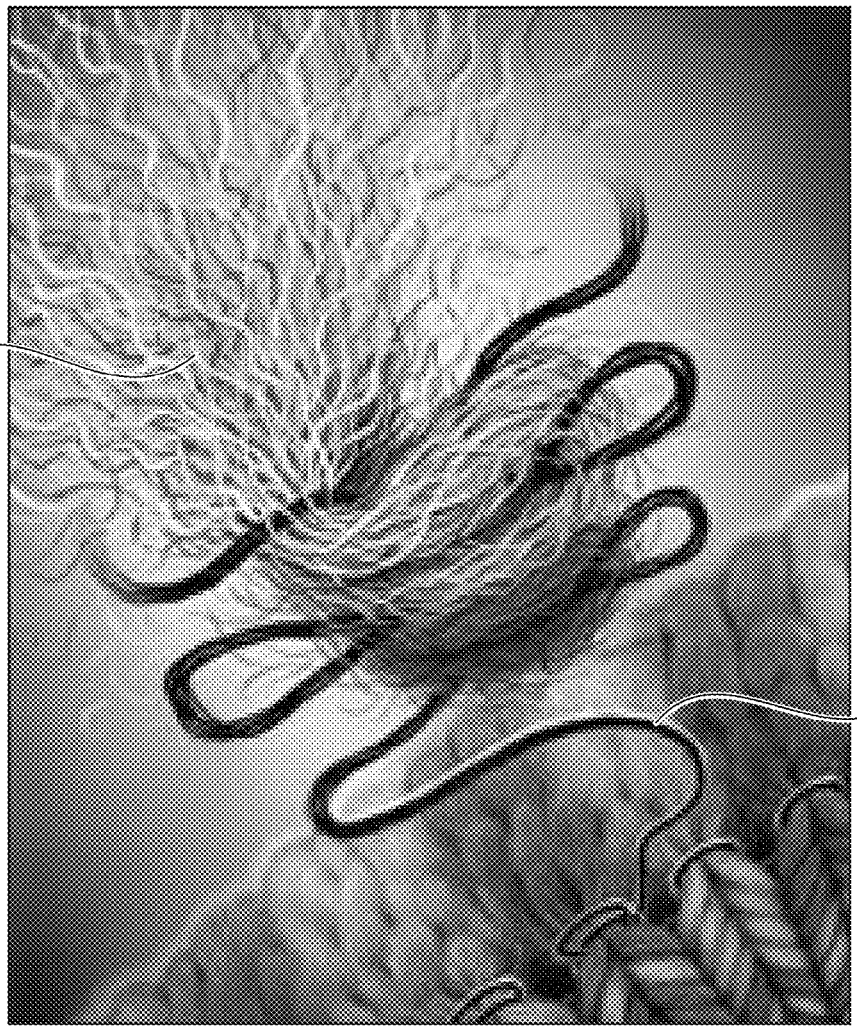
FIG. 4 shows the different textures of the two polyester yarns used in the weaving process.

FIG. 4 shows an enlarged view showing the different textures of the yarns used to create the cover layer. The dark strand represents the PBT base yarn 12, and the lighter strands represent the fibrous polyester yarn 13 that is used to create the pile. The structure of the knitted fabric is shown in FIG. 3, prior to shearing the loops to create the cut pile texture.

Figure 6:
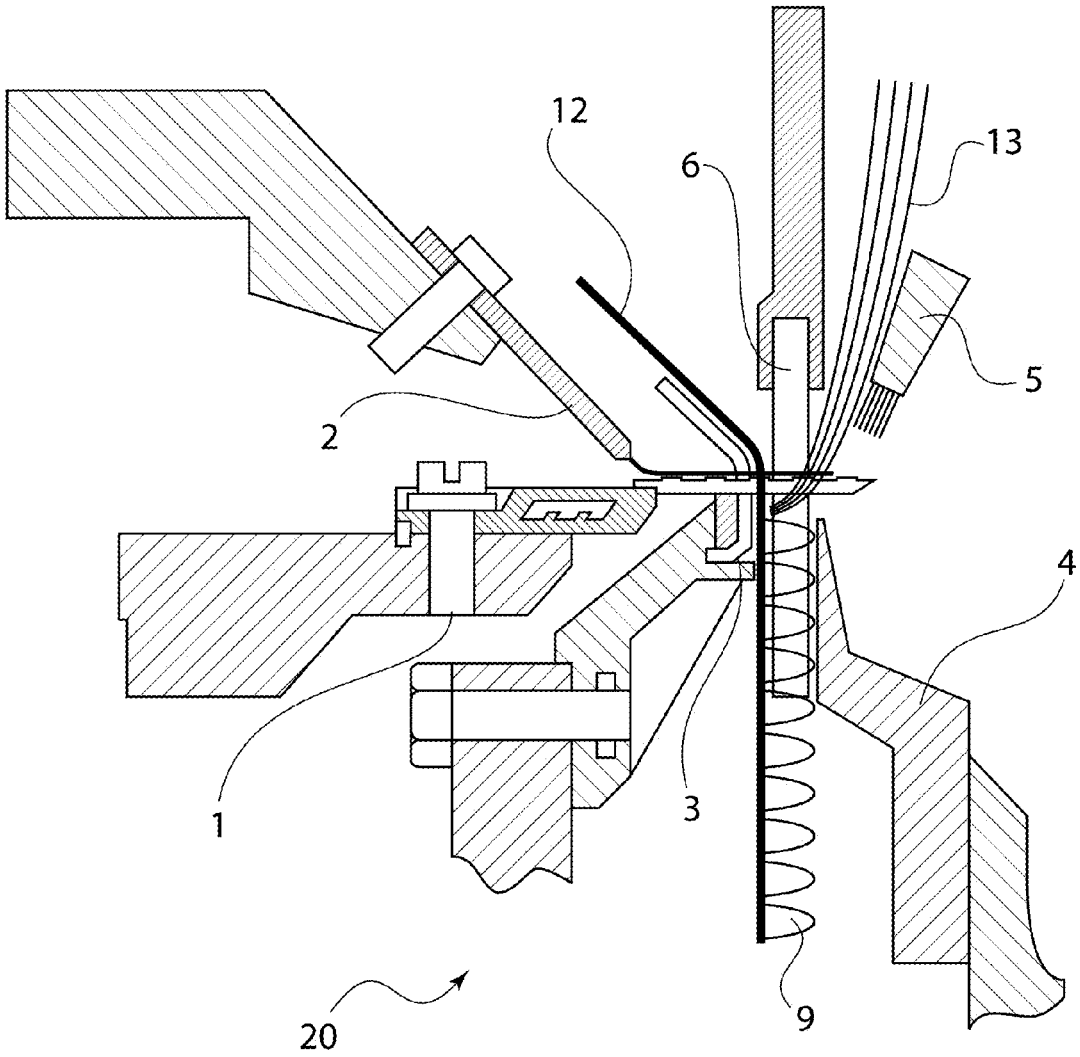
FIG. 6 shows a cross-sectional view of the warp knitting machine used to make the outer cover layer according to the invention.

The warp knitting machine 20 used to create the cover layer shown in FIG. 6. This is a standard warp knitting machine such as the Karl Mayer HKS 3-S, E28. The machine knits the yarns described above into a fabric that has a unique texture, using a knitting speed of 2000 revolutions per minute. The machine consists of a compound needle bar 1, a closing wire bar 2, a k knockover sinker bar 3, a supporting bar 4, an oscillating brush bar 5 and a pile sinker bar 6. The machine knits base yarn 12 and fibrous polyester yarn 13 into a looped pile knit 9. The creation of such a fabric on a warp knitting machine has not been done until now.

Accordingly, while only a few embodiments of the present invention have been shown and described, it is obvious that many changes and modifications may be made thereunto without departing from the spirit and scope of the invention.

What is claimed is:

1. A method for manufacturing a pillow comprising:

knitting a polyester knit matrix on a warp knitting machine, using a base yarn and a pile yarn of polyester;

scratching the knit matrix to create raised loops in the knit;

shearing the loops to create a nap;

stitching panels of the matrix together into a desired shape of a pillow covering; and filling the pillow with a fill of hollow siliconized polyester fibers.

2. The method according to claim 1, further comprising decorating the pillow after the step of filling.

3. The method according to claim 1, wherein a sliver knitting process is used.

* * * * *